US009217265B2

(12) United States Patent
Muller et al.

(10) Patent No.: US 9,217,265 B2
(45) Date of Patent: Dec. 22, 2015

(54) JOINT LOCK

(71) Applicant: ABUS August Bremicker Söhne KG, Wetter-Volmarstein (DE)

(72) Inventors: Thomas Muller, Bischoffen (DE); Martin Hommel, Rehe (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 14/292,011

(22) Filed: May 30, 2014

(65) Prior Publication Data

US 2014/0360233 A1 Dec. 11, 2014

(30) Foreign Application Priority Data

Jun. 5, 2013 (DE) ..... 10 2013 210 475

(51) Int. Cl.
*E05B 73/00* (2006.01)
*E05B 67/00* (2006.01)
*E05B 71/00* (2006.01)

(52) U.S. Cl.
CPC ..... *E05B 67/003* (2013.01); *E05B 71/00* (2013.01); *E05B 73/00* (2013.01); *E05B 73/0005* (2013.01); *Y10T 70/409* (2015.04)

(58) Field of Classification Search
CPC ..... E05B 71/00; E05B 73/00; E05B 73/0005; E05B 67/003; Y10T 70/409
USPC ..... 70/233, 225, 226, 227, 18, 20, 31, 14, 70/19, 30, 49
See application file for complete search history.

(56) References Cited

U.S. PATENT DOCUMENTS 2,848,886 A * 8/1958 Varrin et al. ..... 70/475
3,068,682 A * 12/1962 Russell et al. ..... 70/38 A (Continued)

FOREIGN PATENT DOCUMENTS

CA 967775 A1 5/1975
CA 1018788 A1 10/1977

(Continued)

OTHER PUBLICATIONS

Excerpt from the Specialized Bicycles & Equipment Spring 2003 catalogue.

(Continued)

*Primary Examiner* — Suzanne Barrett
*Assistant Examiner* — Morgan McClure
(74) *Attorney, Agent, or Firm* — Dinsmore & Shohl LLP

(57) ABSTRACT

A joint lock comprises a lock body and a joint bar hoop, wherein the lock body accommodates a lock cylinder and a latch which is selectably movable by the lock cylinder from a locked position into a release position and wherein the joint bar hoop comprises a plurality of joint bars pivotally linked to one another, wherein a first end of the joint bar hoop has an elongate closing bar which can be introduced into an introduction opening of the lock body and which can be locked in the lock body by means of the latch. The joint lock is characterized in that the lock body furthermore accommodates a preloading device which preloads the latch into the locking position, with the latch being temporarily movable against the preloading from the locking position into the release position by introduction of the locking bar into the lock body, with the preloading device being adapted to move the latch back into the locking position again when the locking bar is completely introduced into the lock body.

19 Claims, 7 Drawing Sheets

(56) References Cited

U.S. PATENT DOCUMENTS

| | | | | |
|---|---|---|---|---|
| 3,747,376 | A | 7/1973 | White, Jr. | |
| 3,754,418 | A * | 8/1973 | Miller | 70/18 |
| 3,834,746 | A * | 9/1974 | Hinden | 292/290 |
| 3,855,824 | A * | 12/1974 | Falk | 70/38 A |
| 3,908,414 | A * | 9/1975 | Thorne | 70/18 |
| 3,959,995 | A * | 6/1976 | Fletcher | 70/18 |
| 4,290,279 | A * | 9/1981 | Fish et al. | 70/38 A |
| 4,325,238 | A * | 4/1982 | Scherbing | 70/18 |
| 4,760,718 | A | 8/1988 | Muramatsu et al. | |
| 4,763,784 | A * | 8/1988 | Newell | 206/387.11 |
| 4,881,387 | A * | 11/1989 | Kortenbrede | 70/39 |
| 4,888,967 | A * | 12/1989 | Kuo | 70/52 |
| 5,027,628 | A * | 7/1991 | De Rocher et al. | 70/233 |
| 5,197,310 | A * | 3/1993 | Pedersen | 70/227 |
| 5,265,451 | A * | 11/1993 | Phifer | 70/226 |
| 5,325,689 | A | 7/1994 | Warner | |
| 5,406,811 | A * | 4/1995 | Nakai | 70/26 |
| 5,408,212 | A * | 4/1995 | Meyers et al. | 340/427 |
| 5,447,043 | A * | 9/1995 | Hwang | 70/49 |
| 5,475,993 | A * | 12/1995 | Kuo | 70/18 |
| 5,487,285 | A | 1/1996 | Leichel et al. | |
| 5,488,844 | A * | 2/1996 | Winner | 70/18 |
| 5,709,113 | A * | 1/1998 | Godfrey | 70/233 |
| 5,732,577 | A | 3/1998 | Okada et al. | |
| 5,823,021 | A * | 10/1998 | Chang | 70/38 A |
| 5,913,906 | A | 6/1999 | Strocchi | |
| 5,964,107 | A * | 10/1999 | Chang | 70/33 |
| 6,176,110 | B1 * | 1/2001 | Hao | 70/209 |
| 6,192,720 | B1 * | 2/2001 | Kan | 70/49 |
| 6,389,857 | B1 * | 5/2002 | Meekma et al. | 70/209 |
| 6,427,499 | B1 * | 8/2002 | Derman | 70/58 |
| 6,574,999 | B2 * | 6/2003 | Chen | 70/33 |
| 6,718,802 | B2 * | 4/2004 | Vito | 70/18 |
| 6,725,692 | B2 * | 4/2004 | Weinraub | 70/38 A |
| 6,813,913 | B2 * | 11/2004 | Watts | 70/38 A |
| 6,820,448 | B1 | 11/2004 | Hsieh | |
| 6,923,027 | B1 * | 8/2005 | Kuo | 70/49 |
| 6,990,839 | B1 | 1/2006 | Childres et al. | |
| 7,418,844 | B2 * | 9/2008 | Reeves | 70/38 A |
| 7,437,898 | B2 | 10/2008 | Su | |
| 7,481,084 | B1 * | 1/2009 | Wu | 70/18 |
| 7,712,339 | B2 | 5/2010 | Hentschel et al. | |
| 8,156,772 | B2 | 4/2012 | Buhl et al. | |
| 8,302,435 | B2 * | 11/2012 | Burmesch et al. | 70/34 |
| 8,302,436 | B2 | 11/2012 | Cheung | |
| 8,418,513 | B2 | 4/2013 | Buhl et al. | |
| 8,505,342 | B1 * | 8/2013 | Taiga | 70/14 |
| 8,621,898 | B2 * | 1/2014 | Chen | 70/18 |
| 8,776,560 | B2 * | 7/2014 | Loughlin et al. | 70/233 |
| 8,881,559 | B1 * | 11/2014 | Chang | 70/49 |
| 2002/0139153 | A1 | 10/2002 | Tsai | |
| 2003/0074933 | A1 | 4/2003 | ST. Amand | |
| 2004/0040347 | A1 * | 3/2004 | Vito | 70/18 |
| 2005/0155395 | A1 * | 7/2005 | Yu | 70/30 |
| 2007/0101779 | A1 * | 5/2007 | Muerza | 70/233 |
| 2007/0144223 | A1 | 6/2007 | Stone | |
| 2008/0196454 | A1 * | 8/2008 | Frantz | 70/14 |
| 2009/0025437 | A1 * | 1/2009 | Hentschel et al. | 70/186 |
| 2009/0320531 | A1 * | 12/2009 | Shabtay et al. | 70/49 |
| 2011/0154870 | A1 * | 6/2011 | Buhl et al. | 70/233 |
| 2011/0265526 | A1 * | 11/2011 | Zuraski | 70/18 |
| 2011/0308282 | A1 | 12/2011 | Chen | |
| 2012/0151973 | A1 * | 6/2012 | Cheung | 70/49 |
| 2014/0047872 | A1 * | 2/2014 | Yu | 70/41 |
| 2014/0060126 | A1 * | 3/2014 | Stevens | 70/18 |

FOREIGN PATENT DOCUMENTS

| | | | |
|---|---|---|---|
| CA | 1 083 843 | A1 | 8/1980 |
| CA | 2164654 | A1 | 6/1997 |
| CA | 2249278 | A1 | 4/2000 |
| CA | 2489031 | A1 | 6/2006 |
| CA | 2534763 | A1 | 8/2006 |
| CN | 201321764 | Y | 10/2009 |
| DE | 88 16 431 | U1 | 7/1989 |
| DE | 93 07 702.5 | U1 | 7/1993 |
| DE | 101 17 927 | A1 | 10/2002 |
| DE | 10104850 | C1 | 10/2002 |
| DE | 101 62 284 | A1 | 7/2003 |
| DE | 102 15 532 | A1 | 10/2003 |
| DE | 102 49 222 | A1 | 5/2004 |
| DE | 102004052463 | A1 | 5/2006 |
| DE | 20 2005 013 390 | U1 | 12/2006 |
| DE | 102005040066 | A1 | 3/2007 |
| DE | 20 2007 008 047 | U1 | 8/2007 |
| DE | 20 2007 009 865 | U1 | 10/2007 |
| DE | 20 2007 011 170 | U1 | 12/2007 |
| DE | 20 2008 010 482 | U1 | 11/2008 |
| DE | 10 2009 025 951 | A1 | 12/2009 |
| DE | 10 2009 026 058 | B3 | 7/2010 |
| DE | 20 2010 005 487 | U1 | 7/2010 |
| DE | 10 2009 030 036 | A1 | 12/2010 |
| DE | 10 2011 000 240 | A1 | 12/2011 |
| DE | 10 2010 036 636 | A1 | 2/2012 |
| DE | 10 2011 102 723 | A1 | 11/2012 |
| EP | 0 638 473 | A1 | 2/1995 |
| EP | 0 675 995 | A1 | 10/1995 |
| EP | 0 689 987 | A1 | 1/1996 |
| EP | 1 353 029 | A1 | 10/2003 |
| FR | 2 349 012 | A1 | 11/1977 |
| FR | 2503077 | A1 | 10/1982 |
| JP | 6026258 | | 2/1994 |
| JP | 7069258 | | 3/1995 |
| JP | 8105261 | | 4/1996 |
| JP | 08128245 | | 5/1996 |
| JP | 08142951 | | 6/1996 |
| TW | 201018608 | A | 5/2010 |

OTHER PUBLICATIONS

Folding lock of four photographs as see in "RSP Folding Plate Lock" and Magnum Onguard K-9 2009.

Translation of German Search Report dated Apr. 28, 2014 relating to DE Patent Application No. 10 2013 210 475.5.

* cited by examiner

JOINT LOCK

CROSS-REFERENCE TO RELATED APPLICATIONS

This application claims priority of German Patent Application 102013210475.8 filed on Jun. 5, 2013.

FIELD OF THE INVENTION

The present invention relates to a joint lock having a lock body and a joint bar hoop, wherein the lock body accommodates a lock cylinder and a latch which is selectably movable by the lock cylinder from a locked position into a release position and wherein the joint bar hoop comprises a plurality of joint bars pivotally connected to one another, wherein a first end of the joint bar hoop has an elongate locking bar which can be introduced into an introduction opening of the lock body and which can be locked in the lock body by means of the latch.

BACKGROUND OF THE INVENTION

Such a joint lock serves, for example, for the securing of a two-wheeler to a bicycle stand, to a lamppost or the like. For this purpose, the joint bars of the joint bar hoop which are pivotally connected to one another behind one another or in a row are folded apart and the locking bar, which forms the free end of the joint bar hoop, is locked to the lock body in order hereby to form a closed loop. This closed loop can, for example, engage around a frame section of the two-wheeler and the bicycle stand, lamppost or the like, or the joint bar hoop only surrounds a rim of the two-wheeler to prevent unauthorized persons from riding away.

The joint bars can be folded together to form a compact arrangement by the authorized user for the transport of the joint lock, with it in particular being possible also to lock the locking bar in the lock body in the folded together state of the joint bar hoop, with the joint bar hoop maintaining the folded together shape. To bring the joint bar hoop into the folded together shape, it is known to pivot the joint bars in the manner of a folding yardstick and hereby to bring it into a parallel alignment.

A disadvantage of the known joint locks comprises the fact that the latch has to be moved into the release position by means of the lock cylinder and the matching key in order to introduce the locking bar into the introduction opening of the lock body. The latch subsequently has to be brought into the locking position by means of the key to lock the locking bar in the lock body. Both the introduction of the locking bar into the lock body and the locking of the locking bar in the lock body thus require a manual operation.

SUMMARY OF THE INVENTION

It is an object of the invention to provide a joint lock which is simple to handle.

This object is satisfied by a joint lock having the features of claim 1 and in particular in that the lock body furthermore accommodates a preloading device which preloads the latch into the locking position, with the latch being temporarily movable against the preloading from the locking position into the release position by introduction of the locking bar into the lock body, with the preloading device being adapted to move the latch back into the locking position again when the locking bar is completely introduced into the lock body.

The latch is thus automatically briefly moved from the locking position into the release position simply by the introduction of the locking bar into the lock body, whereby the locking bar can be introduced into the lock body without any additional movement of the lock cylinder. The introduction of the locking bar in this respect takes place against a preloading of the latch which is produced by means of the preloading device. As soon as a section of the locking bar provided for introduction into the lock body is introduced into the lock body, i.e. when the locking bar is completely introduced into the lock body, the latch is urged back into the locking position by the preload, whereby the locking bar is locked in the lock body. A removal of the introduced locking bar from the lock body is not possible in the locking position. The locking bar can only be removed from the lock body again when the latch is moved by the lock cylinder from the locking position into the release position.

In an advantageous manner, the joint lock in accordance with the invention thus allows an automatic function for locking the introduced locking bar without an actuation of the lock cylinder. The handling of the joint lock in accordance with the invention on locking is thus simple and uncomplicated since only the locking bar has to be introduced into the lock body and is automatically locked there.

Advantageous embodiments of the invention are described in the description, in the dependent claims and in the drawings.

In accordance with a first advantageous embodiment, the locking bar has a locking section at a free end which is in operational engagement with the latch in the locking position of the latch to lock the locking bar in the lock body. In this respect, that end of the locking bar is defined as the free end which can be introduced into the lock body. A second end of the locking bar, which is disposed opposite the free end, is pivotally connected to a joint bar of the joint bar hoop, in contrast. The locking section can in particular be in operational engagement with the latch when the locking bar is completely introduced into the lock body.

The locking section of the locking bar is preferably formed by an elevated securing portion, i.e. by an elevated portion with respect to the surface of the locking bar. The elevated securing portion is preferably provided at a broad side of the typically flat locking bar. The latch can be arranged in the locking position such that it is in operational engagement with the elevated securing portion to prevent a pulling of the locking bar out of the lock body in that the latch blocks the movement path of the elevated securing portion and/or cants with the elevated securing portion.

In accordance with a further advantageous embodiment, the preloading device is fastened to the lock cylinder and to the latch. This means that the preloading device engages both at the lock cylinder and at the latch to load the lock cylinder and the latch with respect to one another, whereby the preloading device, the lock cylinder and the latch can form an independent unit. The preloading device can in this respect be configured as a spring, for example.

The latch is preferably configured as a rotating latch which is rotatably supported at a jacket surface of the lock cylinder. The rotating latch can contact an outer jacket surface of the lock cylinder, in particular a cylindrical jacket surface of a cylinder housing, whereby the lock cylinder forms a support surface for the rotating latch. The rotating latch can in this respect have the shape of a sector of a hollow cylinder, with the inner surface of the hollow cylinder contacting the cylindrical outer surface of the lock cylinder. A simple support of the rotating latch is possible in this manner. In addition, the use of a rotating latch considerably increases security against an unauthorized opening of the joint lock since the latch could, for example, be briefly moved out of the locking position into the release position by a hammer blow onto the lock body on a use of a linearly displaceable latch. The triggering of a rotational movement to bring the rotating latch into the release position is, however, not possible by a hammer blow onto the lock body. The named preloading device can be configured as a torsion spring in this embodiment.

In accordance with a further advantageous embodiment, the axis of rotation of the rotating latch coincides with or extends in parallel with an axis of rotation of the lock cylinder. The rotating latch and the lock cylinder can therefore be arranged coaxially or almost coaxially.

The rotating latch advantageously comprises a jacket surface having a cut-out, with the cut-out releasing a movement path of the locking bar in the release position of the rotating latch. In the release position, the rotating latch can be positioned such that the cut-out lies in the movement path of the locking bar and in particular at least releases the named elevated securing portion. If the cut-out is arranged in the movement path of the locking bar, the locking bar can be introduced into or pulled out of the lock body. In the locking position, in contrast, the cut-out of the rotating latch is moved out of the movement path of the locking bar, whereby the movement path of the locking bar or of the named elevated securing portion is blocked and the introduced locking bar is locked in the lock body.

In accordance with a further advantageous embodiment, the aforesaid cut-out extends in a tangential direction along the jacket surface of the rotating latch with respect to the axis of rotation of the rotating latch. The rotating latch can substantially have the shape of a hollow cylinder or of a sector of a hollow cylinder, with the cut-out extending in the peripheral direction of the jacket surface of the rotating latch and extending along a certain angular region of the jacket surface. Consequently, the cut-out or a region of the jacket surface of the rotating latch without a cut-out can selectively be brought into the movement path of the locking bar by a rotation of the rotating latch.

The lock cylinder advantageously has a cylinder housing and a cylinder core which is rotatably supported in the cylinder housing and which is coupled to the rotating latch drive operationally, but with rotational clearance. The cylinder core can selectively be rotationally moved by means of a key associated with the lock cylinder. The rotating latch can be rotated about its axis of rotation by a rotational movement of the cylinder core, which can be transmitted to the rotating latch, to release the movement path of the locking bar or of an elevated securing portion provided thereat, for example. In addition, due to the rotational clearance provided between the cylinder core and the rotating latch, the rotating latch can be temporarily rotated into the release position on the introduction of the locking bar into the lock body, without a rotational movement of the cylinder core being necessary. Subsequently, due to the preload, a return of the rotational latch from the release position into the locking position can take place without a rotational movement of the cylinder core being necessary.

In accordance with an advantageous embodiment, the cylinder core has a drive prolongation whose cross-section is partly formed by a segment of a circle and partly by an abutment edge, with the drive prolongation engaging into a coupling opening of the rotating latch, and with the cross-section of the coupling opening being partly formed by a segment of a circle and partly by a first abutment edge and partly by a second abutment edge which is adjacent to the first abutment edge and includes an angle with it differing from 0° and 180°. A rotational movement of the cylinder core can be transmitted to the rotating latch by means of the drive prolongation to rotate the rotating latch and, for example, to vary the position of the cut-out of the rotating latch. The drive prolongation is in this respect an extension of the cylinder core which is defined by a segment of a circle bounded by a secant. The drive prolongation is likewise set into rotation by a rotation of the cylinder core and transmits its rotational movement to the first abutment edge of the rotating latch, for example. The coupling opening can be formed by a segment of a circle into which a triangular abutment projects, with the first abutment edge being able to be formed by a first secant section and the second abutment edge being able to be formed by a second secant section, the two secant sections including an angle with one another. The aforesaid rotational clearance between the cylinder core and the rotating latch can be defined by this angle, namely in that either the named first abutment edge or the named second abutment edge of the coupling opening of the rotating latch contacts the named abutment edge of the drive prolongation.

The lock body, in particular the internal housing explained in the following, can furthermore comprise an abutment which bounds a rotational movement of the cylinder core and/or of the rotating latch to prevent an overrotation of the cylinder core in the cylinder housing or an overrotation of the rotating latch in at least one rotational direction.

The locking bar can advantageously be introduced along its longitudinal axis into the introduction opening of the lock body, with an axis of rotation of the lock cylinder being oriented perpendicular to a plane which is spanned by the longitudinal axis of the locking bar (i.e. the direction of introduction of the locking bar) and the joint axis of the locking bar, when the locking bar is introduced into the lock body. A rotation of the rotating latch about its axis of rotation can thus be effected on the introduction of the locking bar into the lock body. This can in turn effect the displacement of the cut-out of the rotating latch into the movement path of the locking bar, whereby the locking bar can be completely introduced into the lock body.

The aforesaid plane in particular corresponds to the plane of extent of the joint bars and of the locking bar when the joint bar hoop is folded together in the manner of a yardstick and the joint bars and the locking bar lie next to one another in parallel with one another. An alignment of the lock cylinder in which the direction of introduction of the key extends perpendicular to the named plane is also advantageous in the following manner: When not in use, the joint lock can be stored in an associated lock bag during transport which is typically mounted at the frame tube of a bicycle such that the longitudinal axes of the joint bars extend in parallel with the longitudinal axis of the frame tube and the broad side of the formed joint bar package faces the frame tube (cf., for example, the lock bag shown in DE 20 2005 013 390 U1). If the introduction opening of the key at the lock body in such an arrangement of the joint lock is aligned perpendicular to the aforesaid plane, the key can remain inserted in the lock cylinder during the transport of the joint lock without the key projecting into the movement region of the cyclist and thereby being able to disturb the cyclist in his movement processes.

Alternatively, the locking bar can be laterally pivoted into the introduction opening of the lock body, with an axis of rotation of the lock cylinder being aligned in parallel with the longitudinal axis of the locking bar when the locking bar is introduced into the lock body. The movement path of the locking bar on a lateral introduction into the lock body in the region of the lock body can therefore be approximately perpendicular to a plane which is defined by the axis of rotation of the rotating latch and by the longitudinal axis of the locking bar in the completely introduced state. On a pivoting inward of the locking bar, a rotation of the rotating latch can be effected which allows the complete introduction of the locking bar into the lock body.

Alternatively to the use of a rotating latch, the latch can also be configured as a snap-in latch which projects into the movement path of the locking bar. The snap-in latch can in this respect be temporarily urged back from an end face of the locking bar and can engage into a recess of the locking bar or engage behind an elevated securing portion of the locking bar after the complete introduction of the locking bar into the lock body to lock the locking bar in the lock body. To urge the snap-in latch back, the snap-in latch and/or the end face of the locking bar can comprise a sloped surface by which the snap-in latch is urged back on an introduction of the locking bar into the lock body. In this embodiment, an elevated securing portion at the locking bar is not absolutely necessary since an engagement of the latch can—as explained—be provided in a recess of the locking bar, for example.

It is particularly advantageous if the locking bar has at least one elevated protection portion which is provided—viewed along the longitudinal axis of the locking bar—between the introduction opening of the lock body and the latch when the locking bar is completely introduced into the lock body. Such an elevated protection portion serves for the protection against a manipulation of the latch from the outside, for example when an attempt is made to move the latch in the direction of its release position by means of a flat tool through the introduction opening of the lock body. In other words, the elevated protection portion of the locking bar prevents an access to the operational region between the latch and the locking bar. The elevated protection portion can be configured as a raised portion with respect to a broad side of the locking bar typically of a flat design. The elevated protection portion can in particular be provided at that side of the locking bar which faces the latch within the lock body. The elevated protection portion can be provided, for example, between the introduction opening of the lock body and the named elevated securing portion of the locking bar when the locking bar is completely introduced into the lock body.

A particularly inexpensive manufacture of the joint lock can in particular be achieved in that the lock body has a single-part internal housing with two support openings at two mutually oppositely disposed sides, with the lock cylinder having a cylinder housing and a cylinder core rotatably supported in the cylinder housing (in particular the already named cylinder housing and cylinder core), with the lock cylinder being captured between the two mutually oppositely disposed sides of the internal housing and with the cylinder core being rotatably supported in the two support openings of the internal housing. The single-part internal housing can in this respect be produced as a stamped bent part from metal.

In accordance with an advantageous further development, the named single-part internal housing has at least one bent-over holding tongue which fixes the cylinder housing against a rotation. The cylinder housing can hereby be rigidly fixed in the internal housing in a particularly simple manner. Two such holding tongues are preferably provided which engage at two different sides of a flange section of the cylinder housing.

It is furthermore of advantage if the lock body has a sleeve which peripherally surrounds the named single-part internal housing in order additionally to stabilize it. The sleeve is preferably produced from metal and is completely open at one end to be able to pull the sleeve onto the internal housing. The fixing of the sleeve to the internal housing can take place by shape matching, for example by a spot deformation and a corresponding engaging behind the internal housing at a plurality of points along the periphery.

In accordance with a further advantageous embodiment, a second end of the joint bar hoop is permanently fastened to the lock body. In this manner, a losing or an unintentional falling down of the joint bar hoop can be prevented. The joint bar hoop can in particular be rotatably fastened to the lock body, whereby the lock body is pivotable with respect to the joint bar hoop. The rotatable fastening of the second end of the joint bar hoop to the lock body can be provided in the region of the longitudinal axis of the lock body, i.e. the axis of rotation coincides with the longitudinal axis of the lock body or is only slightly spaced apart herefrom to maximize the length of the closed loop.

In accordance with a further advantageous embodiment, the plastic jacket of the first end of the joint bar hoop has a different color than that of the second end of the joint bar hoop which is pivotally connected to the lock body. Provided that the lock body and the second end of the joint bar hoop are of the same color, the first end of the joint bar hoop, which can be distinguished by color, already visually indicates to the user which end of the joint bar hoop is releasable from the lock body. The respective plastic jacket of the locking bar and of all the joint bars with the exception of the joint bar corresponding to the second end of the joint bar hoop can in particular be of a first color, while the joint bar corresponding to the second end of the joint bar hoop and the lock body can be of a second color different herefrom.

BRIEF DESCRIPTION OF THE DRAWINGS

The invention will be explained in the following only by way of example with reference to the drawings. Elements which are the same or of the same kind are marked by the same reference numerals.

There are shown.

DETAILED DESCRIPTION OF THE PREFERRED EMBODIMENTS

Figure 1A:
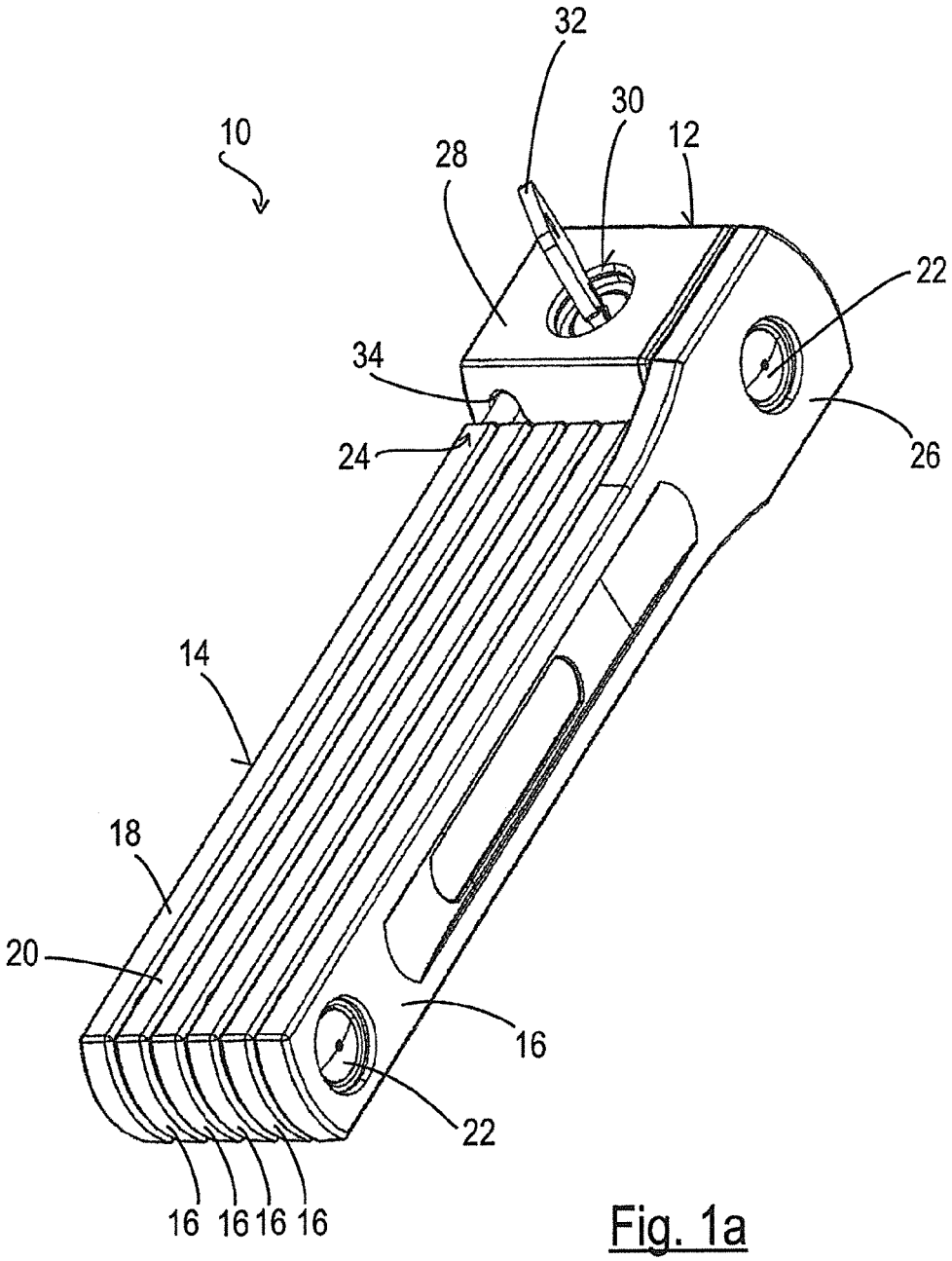
FIG. 1 a joint lock in accordance with the invention in (a) a perspective view obliquely from above; and in (b) a view form above with a removed external housing.

The joint lock 10 shown in FIG. 1*a* comprises a lock body 12 as well as a joint bar hoop 14 fastened thereto. The joint bar hoop 14 can be folded together to form a compact unit and can in this state preferably also be locked at the lock body 12. In the unlocked state of the joint lock 10, the joint bar hoop 14 can be folded apart to form a loop in a known manner and hereby to lock a two-wheeler or to secure it to another object (e.g. a bicycle stand).

The joint bar hoop 14 in detail has a plurality of joint bars 16 of which one is formed as a locking bar 18. The joint bars 16 and the locking bar 18 are each flat and preferably comprise steel which is surrounded by a plastic jacket 20 to avoid damage to the two-wheeler to be locked. The joint bars 16 and the locking bar 18 are pivotally connected to one another in series by a respective rivet 22 such that the joint axes extend in parallel with or coaxial to one another and the joint bar hoop 14 can be folded together in the manner of a yardstick. In the folded-together state of the joint bar hoop 14, the longitudinal axes of the joint bars 16 and of the locking bar 18 extend in a plane in parallel with one another. A first end 24 of the joint bar hoop 14 is formed by the free end of the locking bar 18 which serves as a locking section as will be explained in the following. A second end 26 of the joint bar hoop 14 is pivotally connected to the lock body 14.

The lock body 12 comprises a substantially parallelpiped-shaped external housing 28 which is formed from plastic. The second end 26 of the joint bar hoop 14 is flush with a side wall of the external housing 28. At an upper side of the external housing 28, a key opening 30 is accessible through which a key 32 can be introduced into the lock body 12. The direction of introduction of the key 32 extends perpendicular to a plane defined by the joint bar hoop 14 in the folded together and locked state.

In a region which is disposed opposite the second end 26 of the joint bar hoop 14, the lock body 12 furthermore comprises an introduction opening 34 through which the locking bar 18 can be introduced along its longitudinal axis into the lock body 12. When the locking body 18 is introduced into the introduction opening 34, the locking body 18 is surrounded substantially in a shape matched manner by the bounding of the introduction opening 34 of the external housing 28.

Figure 1B:
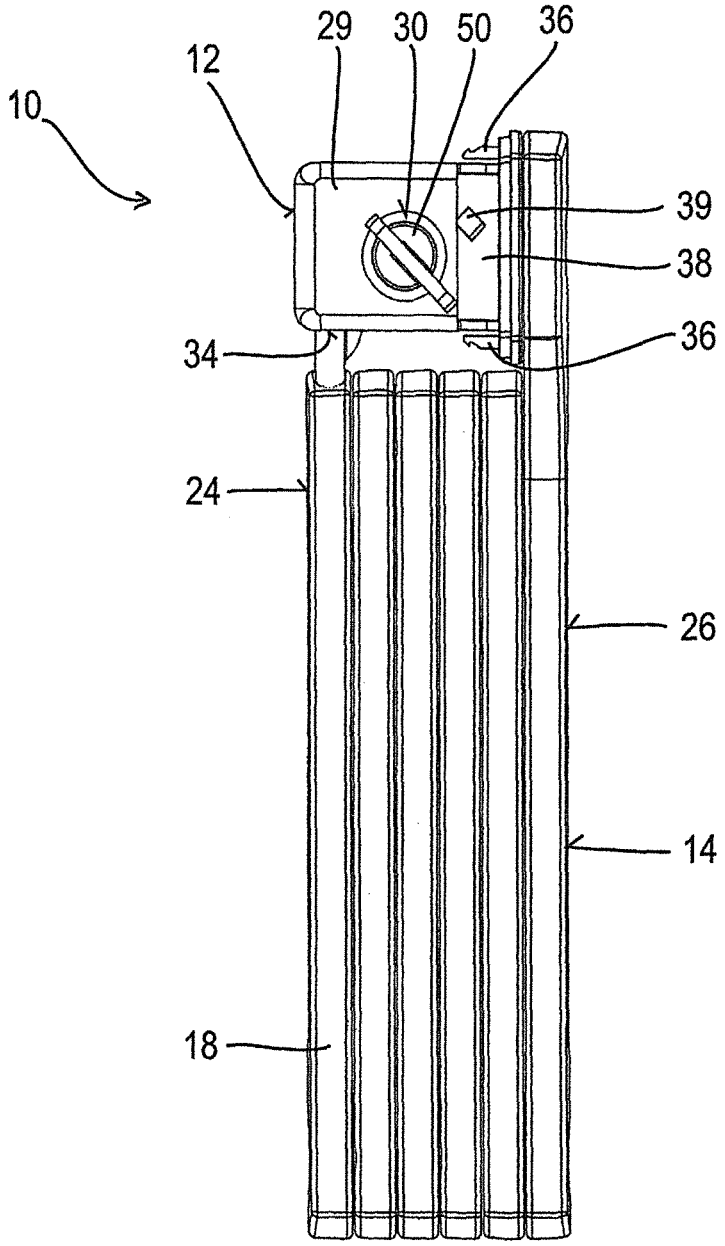

FIG. 1*b* shows the joint lock 10 without the external housing 28. A sleeve 29 of deep drawn sheet metal can be recognized in which the key opening 30 and the introduction opening 34 continue and whose function will be explained in the following.

Figure 2A:
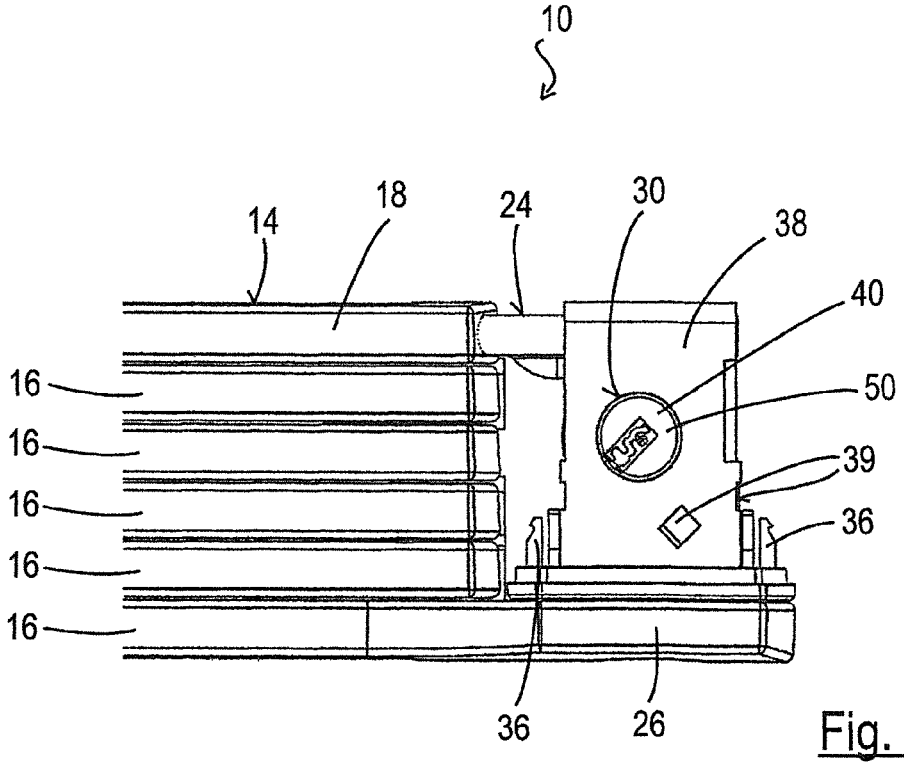
FIG. 2 the region of the lock body of the joint lock of FIG. 1 in (a) a view from above and in (b) a view from below.
Figure 2B:
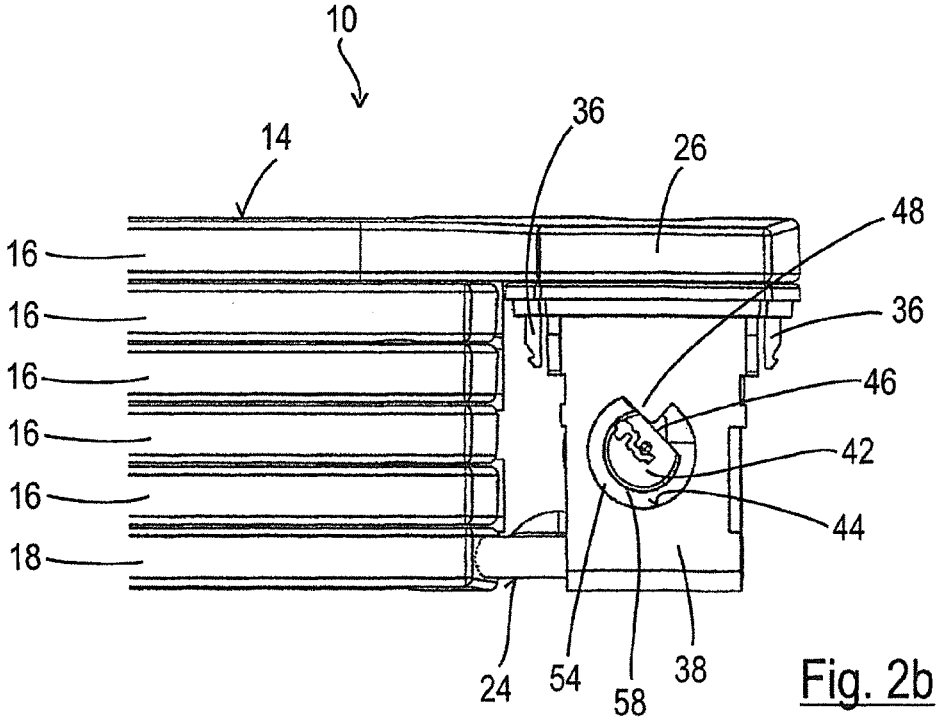

In FIGS. 2*a* and 2*b*, the lock body 12 is shown with an introduced locking bar 18, but without the external housing 28 and without the sleeve 29. The external housing 28, not shown here, is latched at latch projections 36 and accommodates an internal housing in the form of a lock body reinforcement 38 which is produced from steel sheet metal. The lock body reinforcement 38 forms a cage-like structure and in this respect in particular prevents an access into the interior of the lock body 12 from above (cf. FIG. 2*a*) and from below (cf. FIG. 2*b*). The lock body reinforcement 38 is additionally connected in a force-transmitting manner to the rivet 22 of the second end 26 of the joint bar hoop 14 and thus fastens the joint bar hoop 16 rotatably at the lock body 12.

The lock body reinforcement 38 is furthermore formed as a guide of the locking bar 18 and in the completely introduced state of the locking bar 18 prevents a lateral movement, an upward or a downward movement as well as a rotation of the locking bar 18.

The key opening 30 is continued in the lock body reinforcement 38, with the key opening 30 being of circular shape and having a diameter which is matched to the diameter of an upper end of a lock cylinder 40. The upper end of a rotatable cylinder core 50 of the lock cylinder 40 in this respect projects in a shape-matched manner into the key opening 30 of the lock body reinforcement 38, whereby the lock body reinforcement 38 provides a support for the lock cylinder 40 (FIG. 2*a*).

At the lower side (FIG. 2*b*), a drive prolongation 42 of the cylinder core 50 projects into a support opening 44 of the lock body reinforcement 38. The drive prolongation 42 comprises a cross-section which is formed by a segment of a circle bounded by a secant, with the secant defining an abutment edge 46. The bounding of the support opening 44 of the lock body reinforcement 38 comprises a triangular abutment 48 which bounds a rotational movement of the drive prolongation 42 of the cylinder core 50 by cooperation with the named abutment edge 46. In this manner, a rotational actuation of the lock cylinder 40 is also bounded by means of the key 32.

The drive prolongation 42 is likewise indirectly supported by the lock body reinforcement 38 so that the lock cylinder 40 is supported both at its upper end and at its lower end by the lock body reinforcement 38.

The lock body 12 without the lock body reinforcement 38 is shown in FIGS. 3*a*, 3*b*, 4*a* and 4*b*. The lock cylinder 40, which comprises the rotatable cylinder core 50 as well as a fixed-position cylinder housing 52, is arranged within the lock body reinforcement 38 (not shown). The cylinder housing 52 has a hollow cylindrical part in which the cylinder core 50 is supported and has a flange section 53 which projects radially herefrom and in which tumblers are arranged which are urged back by the key 32 in order selectively to be able to unlock the lock cylinder 40 and to be able to rotate the cylinder core 50.

An axis of rotation of the cylinder core 50 of the lock cylinder 40 extends perpendicular to a plane which is spanned by the longitudinal axis of the locking bar 18 and by the joint axis of the locking bar 18 and which is defined by the associated rivet 22. This plane corresponds in FIGS. 2*a*, 2*b*, 3*a* and 3*b* to the plane of the paper and thus to the plane of extent of the joint bars 16 and of the closing bar 18 in the shown folded together state of the joint lock 10. A substantially hollow cylindrical rotating latch 54 is arranged coaxially to the axis of rotation of the lock cylinder 40 and is movably supported at an outer jacket surface 55 of the hollow cylindrical part of the cylinder housing 52. The rotating latch 54 is rotatable about the axis of rotation of the lock cylinder 40 relative to the cylinder housing 52. The rotating latch 54 surrounds a part of the periphery of the lock cylinder 40, with the rotating latch 54 comprising a peripheral clearance through which the flange section 53 of the cylinder housing 52 projects. The peripheral clearance 56 is in this respect larger than the thickness of the flange section 53, whereby the rotating latch 54 has a specific rotational clearance with respect to the locking cylinder 40.

Figure 6:
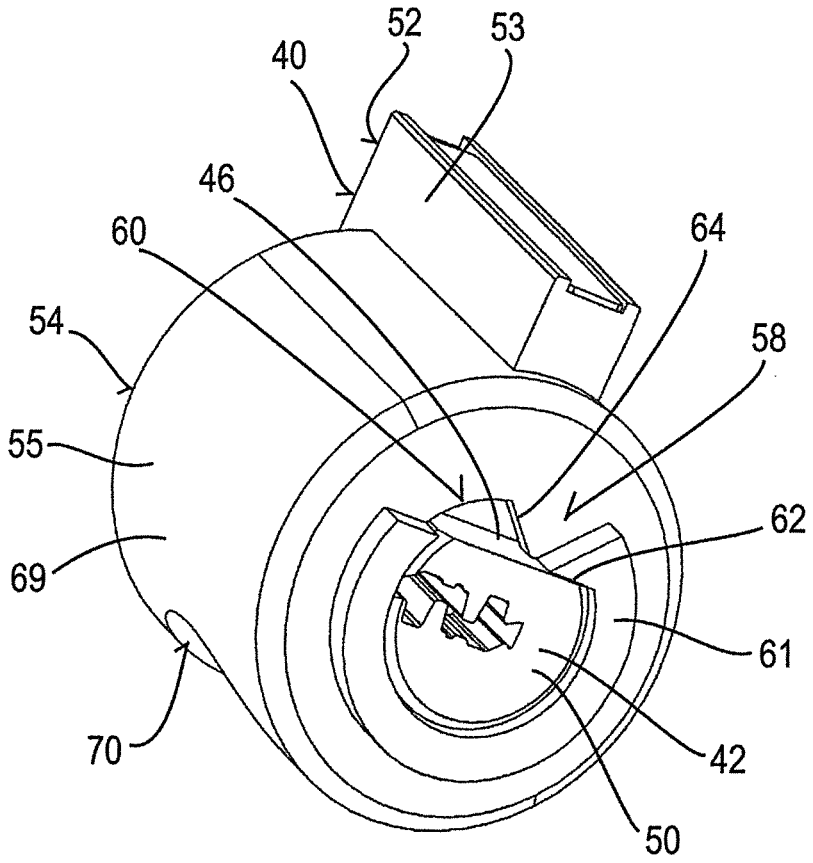
FIG. 6 a perspective representation of the lock cylinder with a rotating latch from below.

At a lower side of the rotating latch 54 the rotating latch comprises a coupling region 58 (FIG. 3*b*) which forms a base of the rotating latch 54 on which the lock cylinder 40 is seated. A coupling opening 60 is provided centrally in the coupling region 58; the drive prolongation 42 of the lock cylinder 40 projects into said coupling opening which is surrounded by a ring section 61. To transmit a rotation of the cylinder core 50 and thus of the drive prolongation 42 to the rotating latch 54, the coupling opening 60 comprises a first abutment edge 62 which is formed by a first secant and which contacts the abutment edge 46 of the cylinder core 50 in the shown closing position of the rotating latch 54. The coupling opening 60 furthermore comprises a second abutment edge 64 formed by a second secant. The first and second abutment edges 62, 64 include an angle of approximately 135° with one another, whereby a rotational clearance of approximately 45° results between the cylinder core 50 and the rotating latch 54. The configuration of the coupling region 58 of the rotating latch 54 is shown even more clearly in the lower view in accordance with FIG. 6.

A spring 66 which runs around the locking cylinder 40 in the locking position of the rotating latch 54 is clamped between the cylinder housing 52 of the lock cylinder 40 and the rotating latch 54, with approximately 270° being swept over by the spring. Two cylindrical prolongations 68 are provided at the rotating latch 54; they project out of the end face at an upper end face of the rotating latch 54 and the spring 66 is threaded through them to establish a force-transmitting connection of the spring 66 to the rotating latch 54.

Figure 3A:
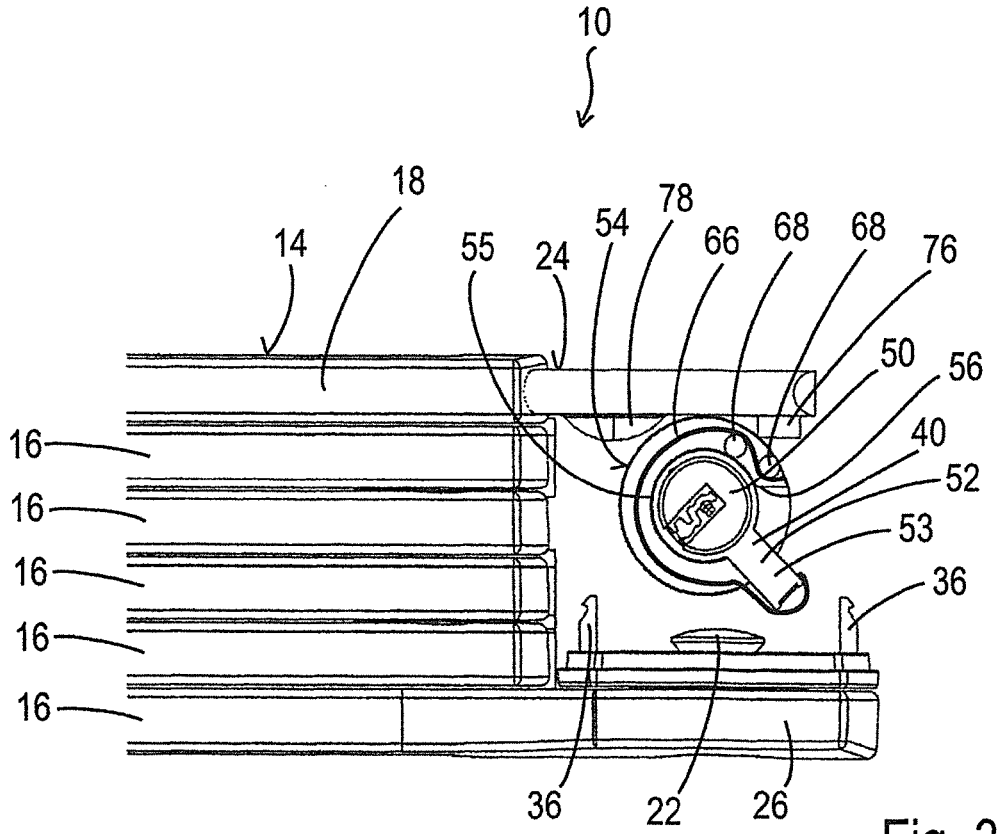
FIG. 3 the region of the lock body of FIG. 2 with an exposed lock cylinder and a rotating latch in (a) a view from above and in (b) a view from below.
Figure 3B:
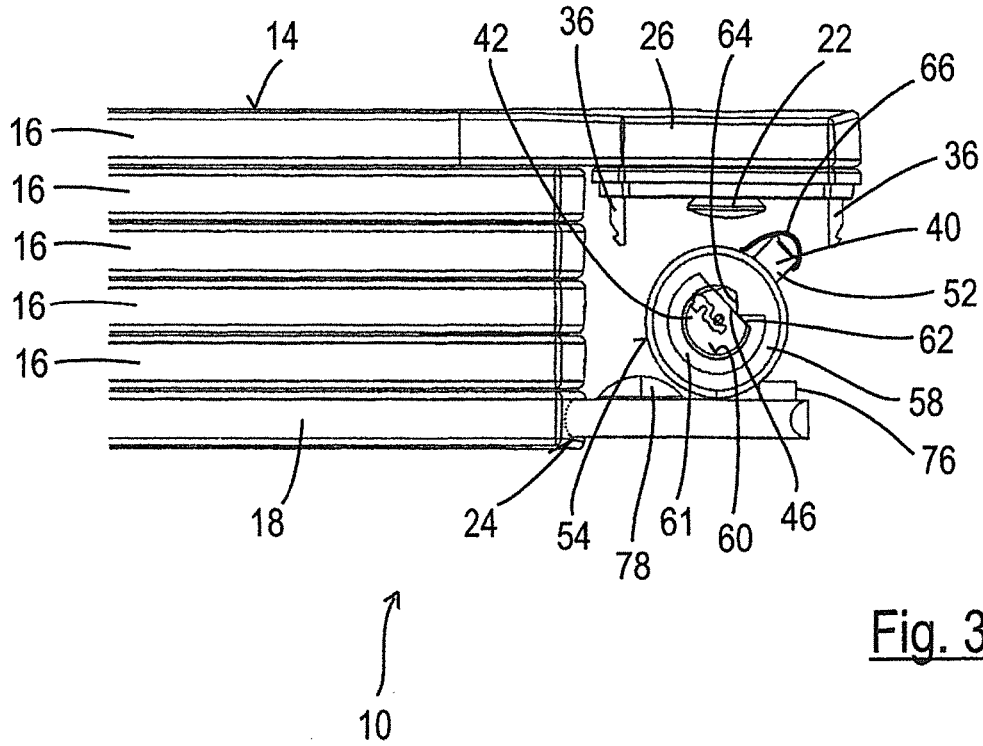
Figure 4A:
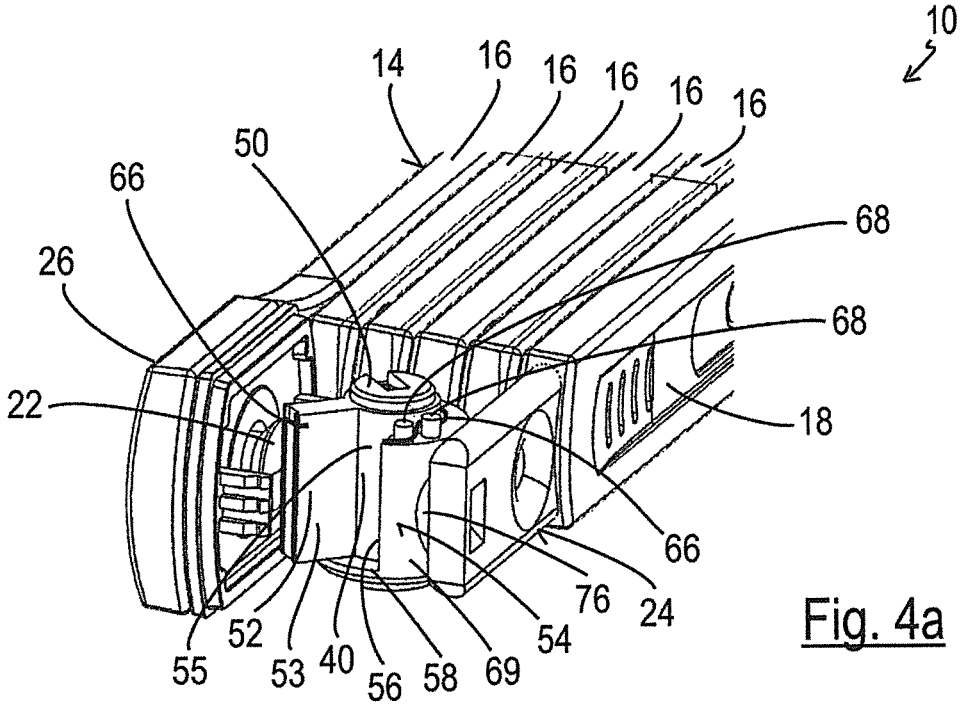
FIG. 4 the region of the lock body of FIG. 3 in (a) a perspective view from the front and in (b) a perspective side view.
Figure 4B:
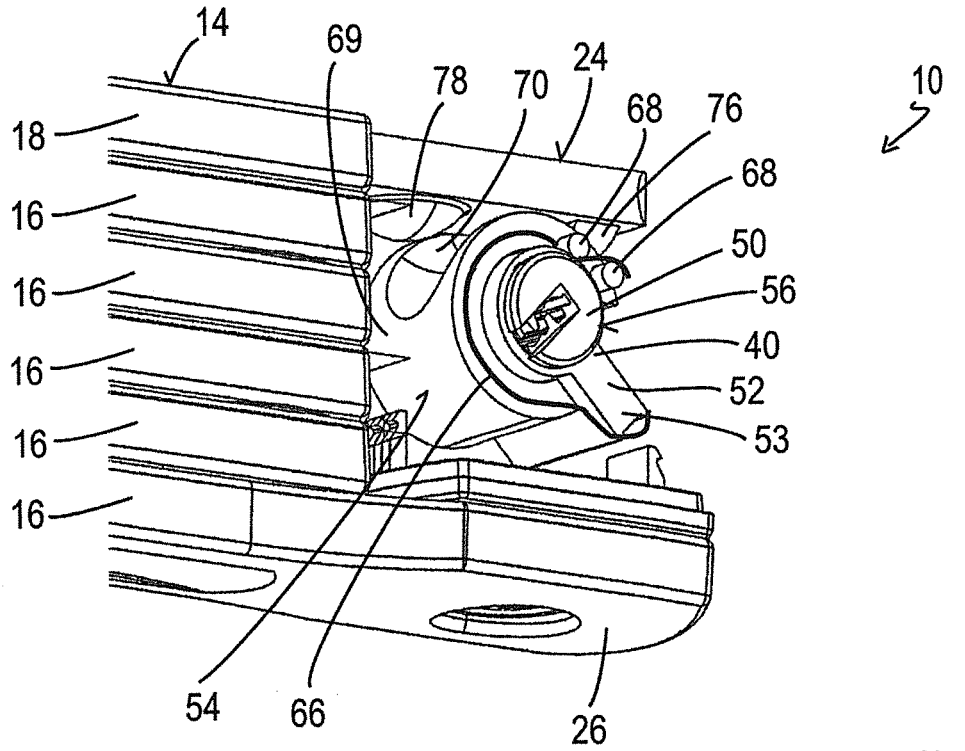

The spring clamps the rotating latch 54 with respect to the cylinder housing 52 such that the rotating latch 54 is urged counter-clockwise in the view of FIG. 3*a*. The rotating latch 54 is pressed by the force of the spring 66 toward a side of the flange section 53 of the cylinder housing at the left (in FIG. 3*a*), with the cylinder housing 52 being immovably fastened in the lock body 12. This is the locking position of the rotating latch 54.

Figure 5:
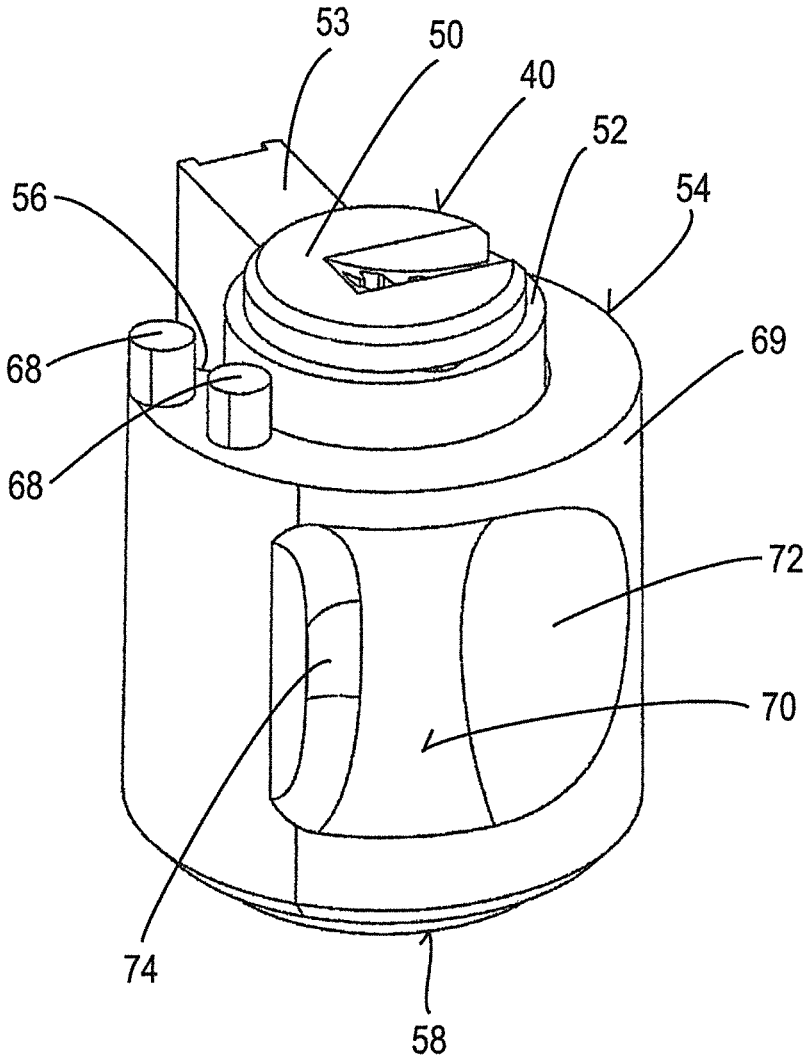
FIG. 5 a perspective representation of the lock cylinder with a rotating latch obliquely from above.

An outer jacket surface 69 of the rotating latch comprises a passage in the form of a cut-out 70 which is shown in detail in FIG. 5. The cut-out 70 comprises a flat region 72 in which the depth of the cut-out 70, viewed in the peripheral direction of the rotating latch 54, increases less than in a steep region 74. The flat region 72 of the cut-out 70 lies—viewed in the direction of introduction of the locking bar 18—in front of the steep region 74.

The depth of the cut-out 70 is matched to the height of an elevated securing portion 76 (FIGS. 3*a*, 3*b*, 4*a* and 4*b*) of the locking bar 18 which is arranged at a broad side of the flat locking bar 18. The elevated securing portion 76 has the shape of a cylinder sector and is arranged in the region of the first end 24 of the locking bar 18 such that it faces in the direction of the rotating latch 54 in the introduced state of the locking bar 18. The elevated securing portion 76 is formed from steel and is not surrounded by the plastic jacket 20. An elevated protection portion 78 which has the shape of a spherical segment is furthermore provided at the first end 24 of the locking bar 18 in the direction of the rivet 22 of the locking bar 18 adjacent to the elevated securing portion 76.

Finally, the fixing of the lock cylinder 40 in the lock body 12 will be explained in more detail. The cylinder core 50 engages in shape-matched manner into the key opening 30 of the lock body reinforcement 38 at the upper side of the lock cylinder 40. The drive prolongation 42 of the cylinder core 50 engages into the support opening 44 of the lock body reinforcement 38 at the lower side of the lock cylinder 40, with the cylinder core 50 being indirectly supported in the support opening 44 via the ring section 61 of the coupling region 58 of the rotating latch 54. The lock cylinder 40 is hereby captured between two mutually oppositely disposed wall sections of the single-part lock body reinforcement 38, i.e. captured in the axial direction and in the radial direction (with respect to the axis of rotation of the lock cylinder 40). In addition, the cylinder housing 52 is rotationally fixedly held in the lock body reinforcement 38 in that two inwardly bent over holding tongues 39 of the lock body reinforcement 38 (cf. FIG. 2*a*) support the flange section 53 of the cylinder housing 52 (cf. FIG. 3*a*) at both sides. A respective blocking of the cylinder housing 52 in both directions of rotation is hereby effected.

The cylinder housing 52 of the lock cylinder 40 is thus fixed in a stationary position in the lock body reinforcement 38 in a very simple manner and without separate fastening elements, with the lock body reinforcement 38 being able to be designed as a single stamped bent part. The sleeve 29 shown in FIG. 1*b* in this respect serves for the additional stabilization of the lock body reinforcement 38 and for the protection of the lock cylinder 40 in that the sleeve 29 surrounds the lock body reinforcement 38 peripherally as well as at the side remote from the rivet 22. The sleeve 29 thus forms an outer box for the lock body reinforcement 38. The sleeve 29 can be pulled over the lock body reinforcement 38 once the lock cylinder 40 has been inserted into the lock body reinforcement 38 in the explained manner and the wall sections of the lock body reinforcement 38 have been bent into their final alignment. After the sleeve 29 has been pulled over, the sleeve 29 is fixed at the lock body reinforcement 38, for example by peening over at four points along the periphery in the region of the latch projections 36.

With regard to the function of the joint lock 10, the locking bar 18 is first introduced into the introduction opening 34 for a closing of the joint lock 10 on the introduction of the locking bar 18 into the lock body 12. The region of the first end 24 of the locking bar 18 surrounded by the plastic jacket 20 is in this respect urged into the lock body 12. If no key 32 is introduced into the lock cylinder 40, the rotating latch 54 is located in the locking position. On the introduction of the locking bar 18, the elevated securing portion 76 is led past the cut-out 70 until the elevated securing portion 76 comes into contact with the rotating latch 54 in the steep region 74. If the locking bar 18 is introduced deeper into the lock body 12, a force is transferred from the elevated securing portion 76 to the steep region of the rotating latch 54, whereby a rotation of the rotating latch 54 against its preload about the axis of rotation of the lock cylinder 40 is triggered (clockwise in FIG. 3*a*). The rotating latch 54 is temporarily rotated into the release position by the rotation of the rotating latch triggered in this manner. For this purpose, the cylinder core 50 of the lock cylinder 40 does not have to carry out any rotation since, as explained, sufficient rotational clearance is provided between the abutment edge 46 of the cylinder core 50 and the second abutment edge 64 of the rotating latch 54 and since the explained peripheral clearance 56 of the rotating latch 54 is also sufficiently large.

The elevated securing portion 76 can be led so far past the rotating latch 54 by the rotation of the rotating latch 54 until the locking bar 18 and thus the elevated securing portion 76 has reached the position shown in the Figures. In the position shown, no force transmission takes place from the elevated securing position 76 to the steep region 74, whereby the rotating latch 54 is automatically rotated back into the locking position by the force of the spring 66.

If an attempt is now made to pull the locking bar 18 out of the lock body 12, the elevated securing portion 76 becomes wedged between the region of the outer jacket surface 69 of the rotating latch 54 and the lock body reinforcement 38. Since the cut-out 70 of the rotating latch 54 is rotated away from the elevated securing portion 76 in the locking position, the elevated securing portion 76 cannot pass between the lock body reinforcement 38 and the rotating latch 54. The locking bar 18 is thus latched in the lock body 12.

The elevated protection portion 78 acts in this locking position of the rotating latch 54 against a manipulation of the rotational position of the rotating latch 54 through the introduction opening 54 of the lock body 12. The elevated protection portion 78 namely prevents that a flat tool is introduced along the locking bar 18 into the introduction opening 34 to urge the rotating latch 54 in the direction of its release position in the interior of the lock body 12.

If, in contrast, the authorized user wants to remove the locking bar 18 from the lock body 12, for example to release his two-wheeler from a bicycle stand, he introduces the key 32 into the lock cylinder 40. Subsequently, a rotational movement of the cylinder core 50 is carried out (clockwise in FIG. 3*a*) using the key 32 by which the drive prolongation 42 is set into a rotational movement. The abutment edge 46 of the cylinder core 50 thereby drives the first abutment edge 62 of the coupling region 58 of the rotating latch 54 and likewise sets the rotating latch 54 in rotation (clockwise in FIG. 3*a*). The cut-out 70 is brought into the movement path of the locking bar 18 (release position of the rotating latch 54) by the rotation of the rotating latch 54, whereby the elevated securing portion 76 is released and can pass between the lock body reinforcement 38 and the rotating latch 54. The locking bar 18 can thus be pulled out of the lock body 12.

Differing from the representation in the drawings, the locking bar 18 can be so short that the joint bar hoop 14 can be folded together into a common plane of extent of the joint bars 16 and of the locking bar 18 without the locking bar 18 being introduced into the lock body 12. The joint lock 10 can hereby be stored or transported in the folded together state, with the locking bar 18 being able to be introduced into the introduction opening 34 of the lock body 12 for a subsequent locking of the joint lock 10 without the locking bar 18 first having to be released from the lock body 12 by means of the key 32. Since—as explained—also no key actuation of the lock cylinder 40 is necessary to lock the locking bar 18 to the lock body 12, the use of the joint lock 10 is thus particularly comfortable.

The invention claimed is:

1. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the latch is configured as a rotating latch, wherein the latch is rotatably supported at a jacket surface of the lock cylinder.

2. The joint lock in accordance with claim 1, wherein the locking bar has at a free end a locking section which is in operational engagement with the latch in the locking position of the latch to lock the locking bar in the lock body.

3. The joint lock in accordance with claim 2, wherein the locking section of the locking bar is formed by an elevated securing portion.

4. The joint lock in accordance with claim 1, wherein the preloading device engages at the lock cylinder, on the one hand, and at the latch, on the other hand.

5. The joint lock in accordance with claim 1, wherein a second end of the joint bar hoop is permanently fastened to the lock body.

6. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the locking bar can be introduced along its longitudinal axis into the introduction opening of the lock body, wherein an axis of rotation of the lock cylinder is aligned perpendicular to a plane which is spanned by the longitudinal axis of the locking bar and the joint axis of the locking bar when the locking bar is introduced into the lock body.

7. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the lock body has a single-part internal housing having two support openings at two mutually oppositely disposed sides, wherein the lock cylinder has a cylinder housing and a cylinder core rotatably supported in the cylinder housing, wherein the lock cylinder is captured between the two mutually oppositely disposed sides of the internal housing and wherein the cylinder core is rotatably supported in the two support openings of the internal housing.

8. The joint lock in accordance with claim 7, wherein the internal housing has at least one bent over holding tongue which fixes the cylinder housing against a rotation.

9. The joint lock in accordance with claim 7, wherein the lock body furthermore has a sleeve which peripherally surrounds the internal housing.

10. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the latch is configured as a rotating latch, wherein the axis of rotation of the rotating latch coincides with an axis of rotation of the lock cylinder or extends in parallel herewith.

11. The joint lock in accordance with claim 10, wherein the locking bar can be introduced along its longitudinal axis into the introduction opening of the lock body, wherein an axis of rotation of the lock cylinder is aligned perpendicular to a plane which is spanned by the longitudinal axis of the locking bar and the joint axis of the locking bar when the locking bar is introduced into the lock body.

12. The joint lock in accordance with claim 10, wherein the locking bar has an elevated protection portion which is provided between the introduction opening of the lock body and the latch when the locking bar is completely introduced into the lock body.

13. The joint lock in accordance with claim 10, wherein the lock body has a single-part internal housing having two support openings at two mutually oppositely disposed sides, wherein the lock cylinder has a cylinder housing and a cylinder core rotatably supported in the cylinder housing, wherein the lock cylinder is captured between the two mutually oppositely disposed sides of the internal housing and wherein the cylinder core is rotatably supported in the two support openings of the internal housing.

14. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the latch is configured as a rotating latch, wherein the rotating latch comprises a jacket surface having a cut-out, with the cut-out releasing a movement path of the locking bar in the release position of the rotating latch.

15. The joint lock in accordance with claim 14, wherein the cut-out extends along the jacket surface of the rotating latch in a tangential direction with respect to the axis of rotation of the rotating latch.

16. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the latch is configured as a rotating latch, wherein the lock cylinder has a cylinder housing and a cylinder core, the cylinder core being rotatably supported in the cylinder housing and being drive-operationally coupled to the rotating latch, but with rotational clearance.

17. The joint lock in accordance with claim 16, wherein the cylinder core has a drive prolongation whose cross-section is formed partly by a segment of a circle and partly by an abutment edge, with the drive prolongation engaging into a coupling opening of the rotating latch and with the cross-section of the coupling opening being formed partly by a segment of a circle, partly by a first abutment edge and partly by a second abutment edge which is adjacent to the first abutment edge and includes an angle therewith.

18. The joint lock in accordance with claim 16, wherein the lock body has an abutment which bounds a rotational movement of at least one of the cylinder core and the rotating latch.

19. A joint lock having a lock body and a joint bar hoop, wherein the lock body accommodates a lock cylinder and a latch, the latch being selectively movable by the lock cylinder from a locking position into a release position, and wherein the joint bar hoop comprises a plurality of joint bars pivotally connected to one another, with a first end of the joint bar hoop having an elongate locking bar which can be introduced into an introduction opening of the lock body and can be locked in the lock body by means of the latch, the lock body further accommodating a preloading device which preloads the latch into the locking position, with the latch being temporarily movable against the preload from the locking position into the release position by introduction of the locking bar into the lock body, and with the preloading device being adapted to move the latch back into the locking position again when the locking bar is completely introduced into the lock body, wherein the latch is configured as a rotating latch, wherein the locking bar can be introduced along its longitudinal axis into the introduction opening of the lock body, wherein an axis of rotation of the rotating latch is aligned perpendicular to a plane which is spanned by the longitudinal axis of the locking bar and a joint axis of the locking bar when the locking bar is introduced into the lock body.

* * * * *